US012012766B2

(12) United States Patent
Delestre

(10) Patent No.: US 12,012,766 B2
(45) Date of Patent: Jun. 18, 2024

(54) TAPE APPLICATOR WITH AUTOMATIC TAPE ARRANGEMENT DURING FILLING, AND METHOD FOR FILLING SUCH AN APPLICATOR

(71) Applicant: ÉTABLISSEMENTS PIERRE GRÉHAL ET CIE SA, Baillet en France (FR)

(72) Inventor: Lionel Delestre, Beaumont-sur-Oise (FR)

(73) Assignee: ÉTABLISSEMENTS PIERRE GRÉHAL ET CIE SA, Baillet en France (FR)

( * ) Notice: Subject to any disclaimer, the term of this patent is extended or adjusted under 35 U.S.C. 154(b) by 312 days.

(21) Appl. No.: 17/608,486

(22) PCT Filed: May 29, 2019

(86) PCT No.: PCT/FR2019/000086
§ 371 (c)(1),
(2) Date: Nov. 3, 2021

(87) PCT Pub. No.: WO2020/240098
PCT Pub. Date: Dec. 3, 2020

(65) Prior Publication Data
US 2022/0213698 A1 Jul. 7, 2022

(51) Int. Cl.
*B32B 41/00* (2006.01)
*E04F 21/02* (2006.01)
*E04F 21/165* (2006.01)

(52) U.S. Cl.
CPC ..... *E04F 21/026* (2013.01); *E04F 21/1657* (2013.01)

(58) Field of Classification Search
CPC .. E04F 21/026; E04F 21/1657; E04F 21/1655
USPC ..... 156/60, 64, 350, 351, 378, 379
See application file for complete search history.

(56) References Cited

U.S. PATENT DOCUMENTS

| | | | |
|---|---|---|---|
| 2,328,571 | A | 9/1943 | Meyer |
| 3,707,427 | A | 12/1972 | Erickson |
| 4,105,490 | A | 8/1978 | Lass |
| 5,114,527 | A | 5/1992 | Stern et al. |
| 6,367,534 | B1 | 4/2002 | McGlenn |

*Primary Examiner* — Michael N Orlando
*Assistant Examiner* — Joshel Rivera
(74) *Attorney, Agent, or Firm* — Clark & Brody LP

(57) ABSTRACT

The invention relates to a strip applicator (1) for ensuring the joint between two plaster boards. The applicator comprises a coating container (4) wherein a strip unwinds in use, the container having a rear wall, a bottom wall, a front wall, a top wall and two side walls, one of which forms a removable side cover for accessing the inside of the container. According to the invention, the lower wall comprises an opening (14) provided with a removable plug (15) for accessing the inside of the container, the opening being directed towards the upper wall of the container.

11 Claims, 5 Drawing Sheets

[Fig. 1]
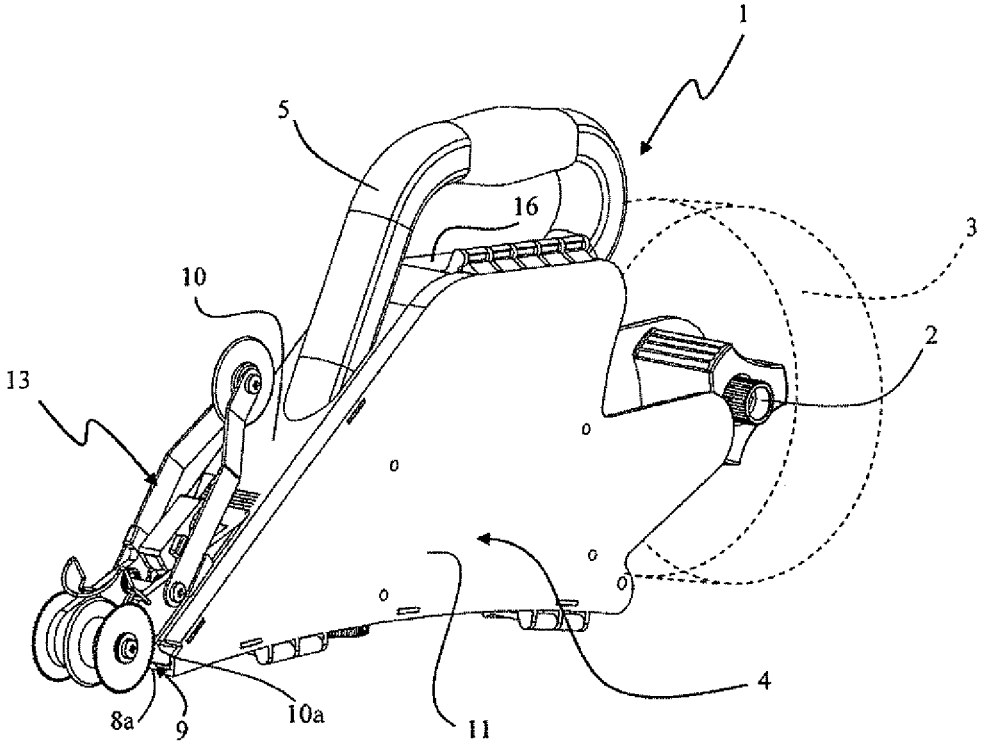
[Fig. 2]
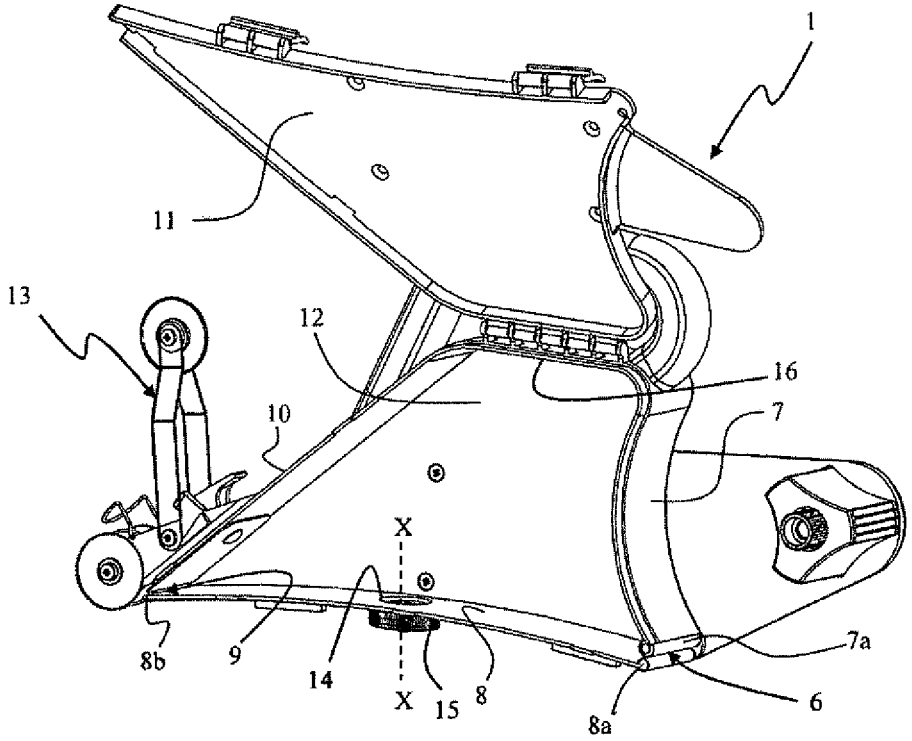

[Fig. 3]
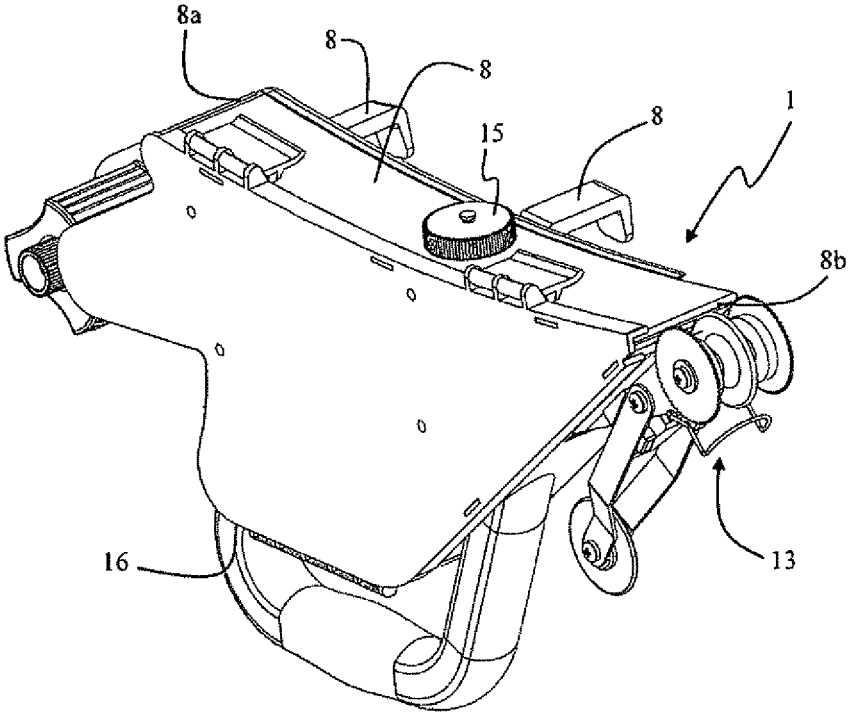
[Fig. 4]
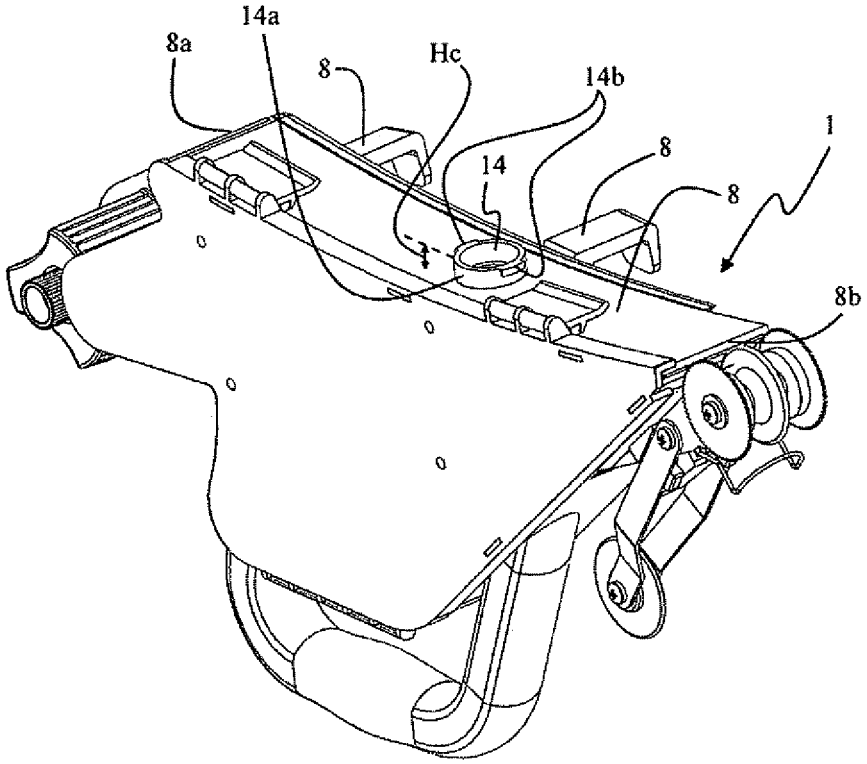

[Fig. 5]
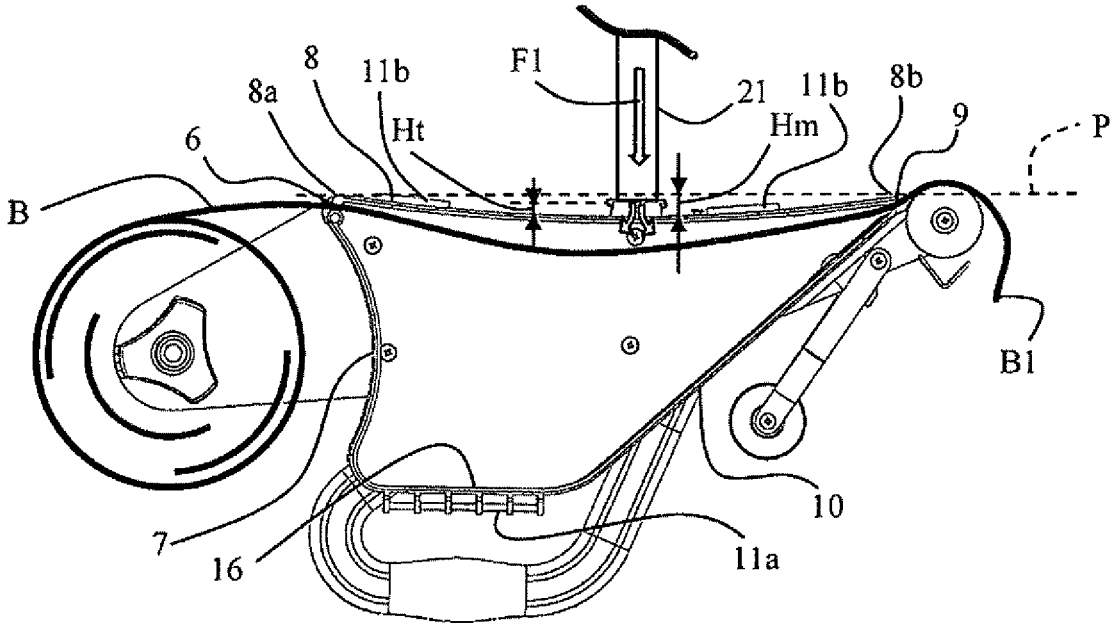
[Fig. 6]
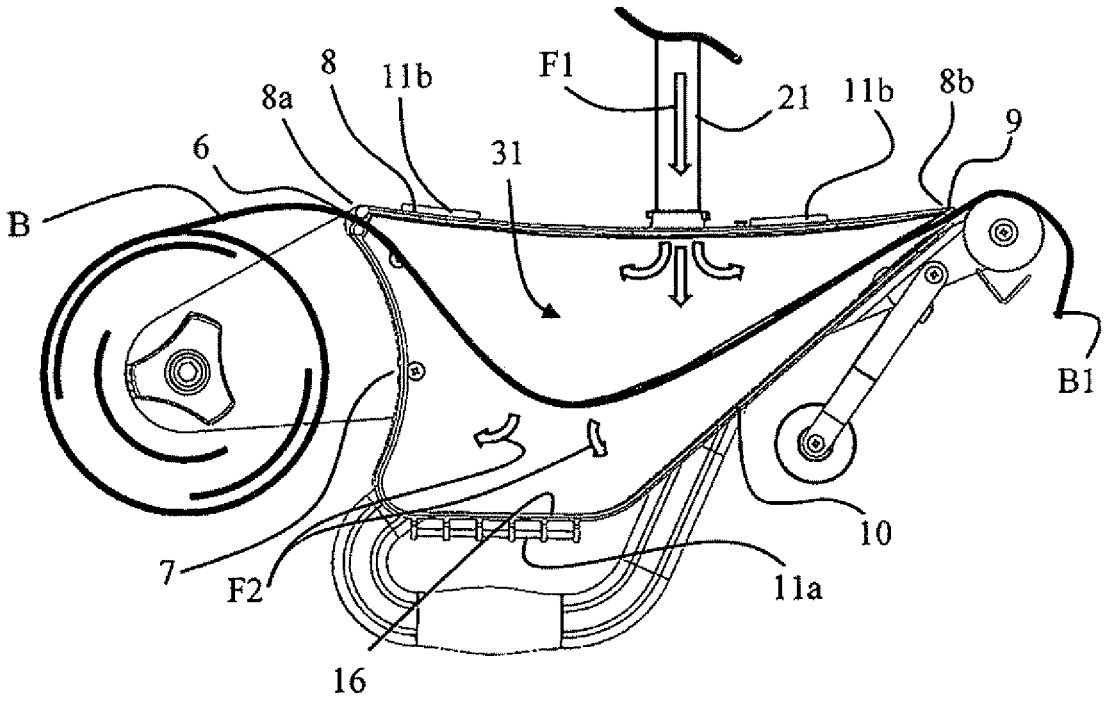

[Fig. 7]
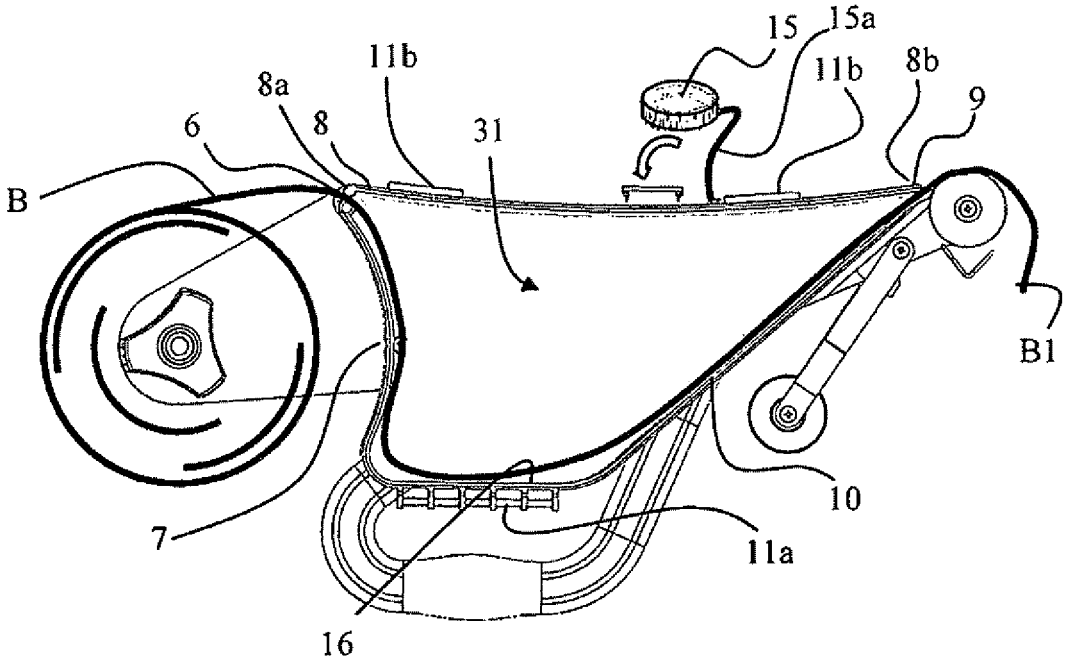
[Fig. 8]
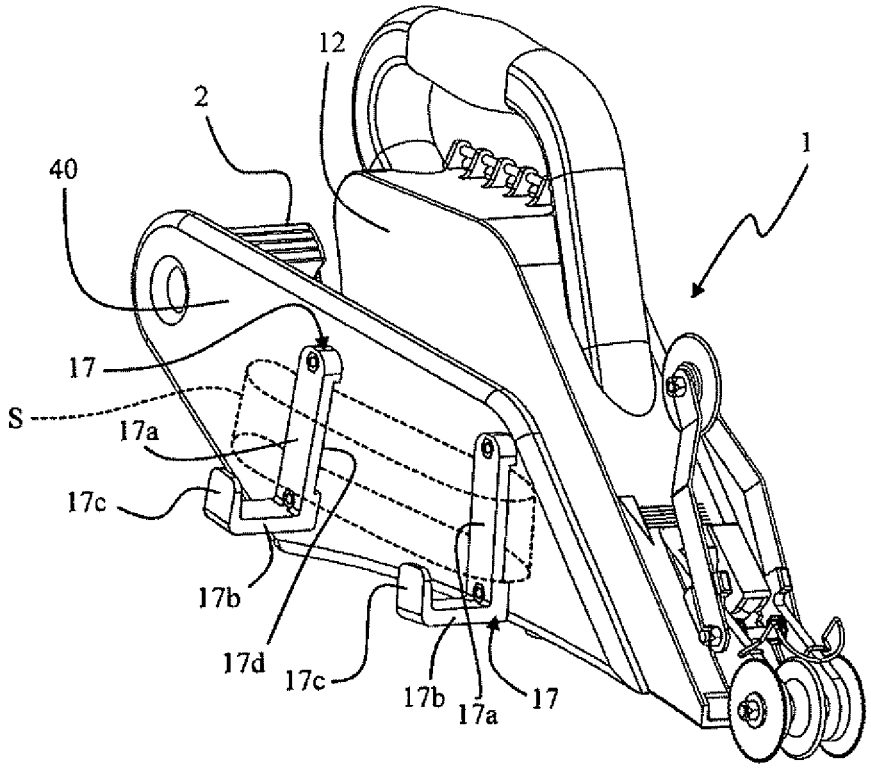

[Fig. 9
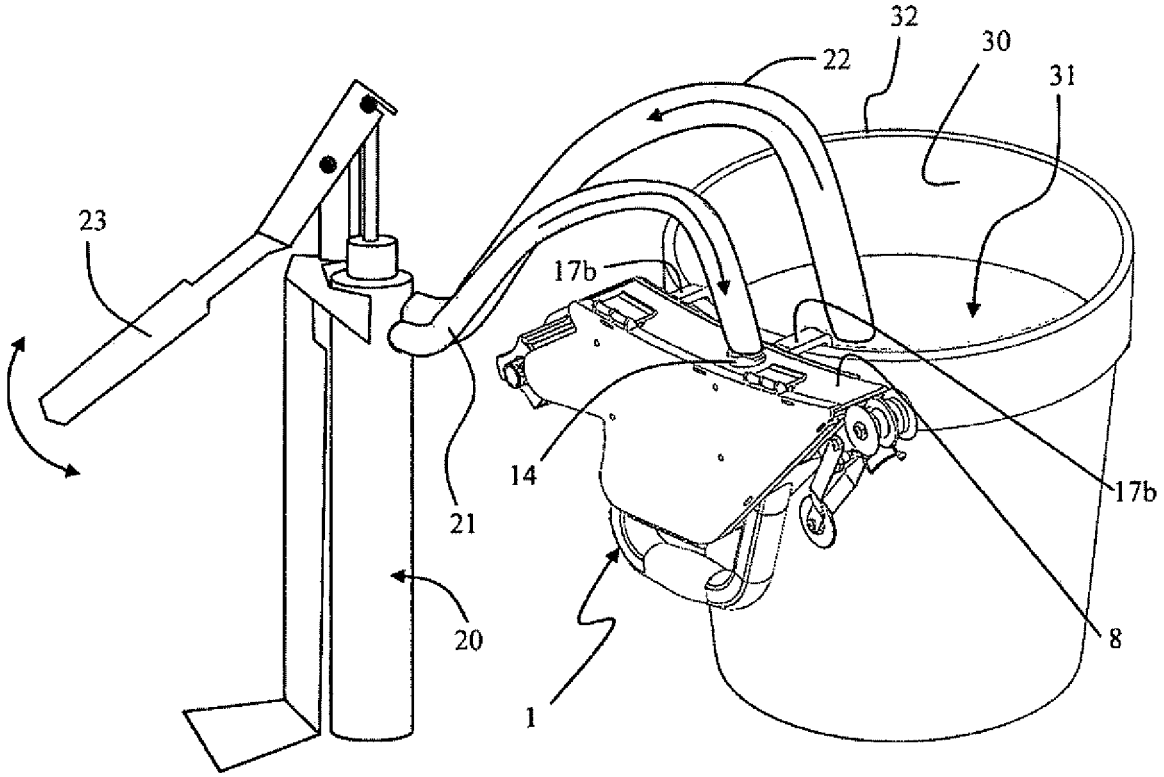

TAPE APPLICATOR WITH AUTOMATIC TAPE ARRANGEMENT DURING FILLING, AND METHOD FOR FILLING SUCH AN APPLICATOR

The present invention relates to an applicator of jointing tape for joining two sheets of plasterboard, with automatic tape arrangement during filling, and to a method for filling such an applicator.

An applicator of jointing tape is intended for laying a tape made of paper or similar material, in the form of a roll, between two adjacent sheets of plasterboard, during building or renovation work, using a pasty jointing compound known as mud.

Thus, the mud fills the space between the two sheets and the tape holds them together.

The tape is laid along two sheets positioned in one and the same plane or at a corner-forming angle. Once the mud and the tape are in position, the user smooths them using a flat spatula, or a corner spatula for the corners. The tape thus makes it possible to obtain a perfectly smooth join between the sheets.

Two types of tape applicator are known.

The first, commonly known as a taping "bazooka", is illustrated, for example, in the document U.S. Pat. No. 4,105,490.

It comprises a tubular mud conduit connected, in use, to a pump that is controllable by a trigger borne by the conduit. The latter also comprises at its operational end a payout device for paying out a jointing tape from a roll and a tape application head. In use, the application head unwinds the tape against the sheets and the user controls the pump such that it ejects mud under the tape.

This type of applicator is very bulky and tiring to handle, since a large part overhangs. Furthermore, it is constantly connected to the pump throughout its use, making it difficult to handle and making it necessary to carry the weight of the hose. Moreover, it is expensive and complex since it is necessary, during the laying of the tape, to manage the supply of mud and the unwinding of the tape. In this type of applicator, there is no chamber in which the tape is loaded automatically with mud. Finally, the systematic connection to the pump requires a sealed connector in order to avoid getting mud everywhere, this making the design complex and fragile and requiring regular maintenance of the seals.

The second type of tape applicator, commonly known as a taping "banjo" and illustrated, for example, in the document U.S. Pat. No. 2,328,571, comprises a mud chamber in which the tape is loaded with mud during application. It also comprises a payout device for paying out a jointing tape from a roll in order to carry out numerous jointing operations, in particular on large jobs.

To this end, the chamber has, with reference to the use position, a tape inlet slot formed between a free end of a rear wall of the chamber and a first free end of a lower wall of the chamber, and a tape outlet slot formed between a free end of a frontal wall of the chamber and a second free end of the lower wall of the chamber.

To fill the chamber, that latter also has two side walls, one of which constitutes a removable side cover for accessing the inside of the chamber. The cover may be removed by being withdrawn or by being pivoted.

To fill applicators of the taping banjo type, the cover is opened, the tape is positioned manually against the rear, upper and frontal walls, then the space formed between the tape positioned in this way and the lower surface of the chamber is filled with mud.

This filling operation, which is carried out manually generally with a coating knife, is tricky since it is necessary to introduce the mud carefully, without getting it outside the chamber, while holding the tape in the filling position, that is to say against the frontal, rear and upper walls. In practice, this operation is very dirty and requires a surprisingly large amount of know-how.

Therefore, an objective of the present invention is to propose a tape applicator that can be refilled quickly and easily even by a beginner user, which limits the risks of soiling during filling and which ensures that the tape is positioned optimally and automatically in the chamber.

Another objective of the invention is to propose an applicator that is easy to handle during application of the tape, that is to say lightweight and without any hose for connecting to a pump, in use.

Another objective is to propose an applicator of simple and robust design, which is easy to maintain, and in which the number and complexity of the parts that make it up is limited.

Another objective of the invention is to propose an applicator that ensures clean application without leaving a trace, regardless of the position in which the user's hand grasps it.

An objective of the present invention is to propose an application head that provides simple dynamics and manipulations for switching from the retracted position to the position of use without the need to remove the entire head.

According to the invention, the applicator comprises a structure such that it has to be filled upside down, that is to say with the lower wall at the top. By virtue of such filling, an applicator is obtained, the filling of which is not only easy and not very dirty, but also multifunctional, meaning that it can be carried out either manually by gravity or with a syringe, or with a pump connected temporarily to the applicator, without this requiring a sealed connection to the pump by means of a leaktight connector. Moreover, unexpectedly, upside-down filling makes it possible to automatically position the tape perfectly in the filling position, that is to say against the frontal, rear and upper walls, since it is driven by the weight of the mud, with twisting of the tape being avoided during filling. By contrast, if filling were effected top side up, that is to say with the lower wall at the bottom, not only would a leaktight connection to the pump be required, but there would be a risk of the tape twisting in the chamber and not being positioned properly, since it would not by driven by the weight of the mud.

Thus, one subject of the invention is an applicator of jointing tape for joining two sheets of plasterboard, the applicator comprising a payout device for paying out a jointing tape from a roll and a mud chamber through which the tape is paid out in use, the chamber having, with reference to the use position, a tape inlet slot formed between a free end of a rear wall of the chamber and a first free end of a lower wall of the chamber, and a tape outlet slot formed between a free end of a frontal wall of the chamber and a second free end of the lower wall of the chamber, the chamber also comprising an upper wall and two side walls, one of which constitutes a removable side cover for accessing the inside of the chamber, and wherein the lower wall comprises an orifice provided with a removable stopper for accessing the interior of the chamber, the orifice being directed toward the upper wall of the chamber.

According to particular embodiments:

the lower wall of the chamber may be concave, as seen from the outside, with respect to a base plane passing through the first and the second free end of the lower wall, and have a recess with a maximum height greater than or equal to a height of the orifice provided with the stopper, the orifice being arranged in the recess such that the stopper does not protrude beyond the base plane;

at least one of the side walls may have two fixing hooks that are intended, while the chamber is being filled with mud, to allow the applicator to be fixed against the edge of a bucket of mud, such that the stopper and the lower wall of the chamber are directed upward;

the hooks may comprise a fixing leg for fixing to the side wall of the chamber, the fixing leg being extended angularly by a bearing leg for bearing against a bucket edge while the chamber is being filled with mud, the bearing leg being extended angularly by an immobilizing leg intended to immobilize the applicator against the wall of the bucket while the chamber is being filled with mud;

the fixing leg of each hook may have a groove for a carry strap of the applicator to pass through;

the side wall forming the removable side cover may be mounted in a pivotable manner on the upper wall, and comprises means for reversibly fixing to the lower wall to allow leaktight reversible closure of the cover;

the orifice may be extended by a peripheral rim of given height;

the orifice may be circular and extended by a cylindrical rim;

the cylindrical rim may have two fins arranged centrifugally and on diametrically opposite sides from one another, the stopper having a rim of complementary shape, comprising two tabs arranged centripetally and on diametrically opposite sides from one another, the tabs being intended to be force-fitted between the fins and the lower wall when the stopper is closed and to pass between the fins when the stopper is pivoted through a quarter turn to open up the orifice; and/or a flexible connecting line may be fixed between the stopper and the lower wall of the chamber.

Another subject of the invention is a method for filling an empty applicator of jointing tape using a mud pump, the method comprising the following steps:

a) providing an applicator of jointing tape as above, b) inserting a free end of the tape into the chamber through the inlet slot and withdrawing the free end of the tape from the chamber through the outlet slot, the tape extending freely through the chamber;

c) opening the stopper of the orifice borne by the lower wall of the chamber;

d) inserting a supply hose of a pump connected to a container of mud into said orifice;

e) keeping the free end of the tape out of the chamber and actuating the pump in order that mud enters the chamber, pushing the tape back toward the upper wall, the rear wall and the frontal wall until the chamber has been filled;

f) removing the supply hose of the pump from the orifice and closing the stopper in order to obtain a full applicator of jointing tape that is ready to use.

Another subject of the invention is a method for adding mud to an applicator of jointing tape using a mud pump, characterized in that it comprises the following steps:

a) providing an applicator of jointing tape as above, wherein the tape already extends freely through the chamber, a free end of the tape emerging from the chamber through the outlet slot, b) opening the stopper of the orifice borne by the lower wall of the chamber;

c) inserting a supply hose of a pump connected to a container of mud into said orifice;

d) keeping the free end of the tape out of the chamber and actuating the pump in order that mud enters the chamber, pushing the tape back toward the upper wall, the rear wall and the frontal wall until the chamber has been filled;

e) removing the supply hose of the pump from the orifice and closing the stopper in order to obtain a full applicator of jointing tape that is ready to use.

Further features of the invention will be stated in the following detailed description, given with reference to the appended drawings, in which, respectively:

FIG. 1 shows a schematic perspective view of a tape applicator according to the invention in the use position, namely in the position for applying a tape;

FIG. 2 shows a schematic perspective view of the tape applicator in FIG. 1, from which one of the side walls has been removed to show the internal structure of the applicator;

FIG. 3 shows a schematic perspective view of the tape applicator in FIG. 1 in the filling position according to the invention, with the stopper closed;

FIG. 4 shows a schematic perspective view of the tape applicator in FIG. 1 in the filling position according to the invention, with the stopper open;

FIG. 5 shows a schematic view in cross section of the tape applicator in FIG. 4 at the start of filling;

FIG. 6 shows a schematic view in cross section of the tape applicator in FIG. 4 during filling;

FIG. 7 shows a schematic view in cross section of the tape applicator in FIG. 4 at the end of filling;

FIG. 8 shows a schematic perspective view of a tape applicator according to the invention, comprising fixing hooks for fixing the applicator in the filling position against a bucket of mud; and FIG. 9 shows a schematic perspective view of the tape applicator in FIG. 8 in the filling position against a bucket of mud and connected to a manual filling pump.

An applicator provided with an orifice for accessing the inside of the chamber according to the invention is illustrated in FIG. 1.

The applicator 1 comprises a payout device 2 for paying out a jointing tape from a roll 3 (illustrated in dotted line) and a mud chamber 4 through which the tape is paid out in use.

The applicator also comprises a holding handle 5 for transporting it or handling it operationally during application of the tape.

Alternatively or in combination, the applicator may comprise a carry strap (S; see FIG. 8) allowing the applicator to be picked up from beneath.

As illustrated in FIG. 2, the chamber 4 has, with reference to the use position, a tape inlet slot 6 formed between a free end 7*a* of a rear wall 7 of the chamber and a first free end 8*a* of a lower wall 8 of the chamber.

The chamber 4 also comprises a tape outlet slot 9 formed between a free end 10*a* of a frontal wall 10 of the chamber and a second free end 8*b* of the lower wall 8 of the chamber.

The chamber further comprises two side walls 11 and 12, one of which constitutes a removable side cover 11 for accessing the inside of the chamber 4.

An application head 13 according to the invention is fixed to the frontal wall 10 of the chamber 4.

According to the invention, the lower wall 8 comprises an orifice 14 provided with a removable stopper 15 for accessing the inside of the chamber. The orifice 13 is directed toward the upper wall 16 of the chamber, meaning that it is directed upward, with reference to the use position illustrated in FIGS. 1 and 2. In other words, the orifice has an axis of symmetry X-X perpendicular to the lower wall 8.

Thus, the orifice is next to the tape when the latter is in the use position and extends through the chamber between the inlet slot 6 and the outlet slot 9.

Thus, during the filling method according to the invention, the mud enters perpendicularly to the tape and pushes the latter back by gravity toward the upper wall, as will be explained in relation to FIGS. 5 to 7.

On account of this arrangement, the chamber is filled "upside down", meaning that the applicator is turned over such that the lower wall 8 is located at the top and the upper wall 16 is located at the bottom.

It is in this position that the applicator 1 is illustrated in FIG. 3, before any filling. Thus, the orifice 14 is closed in a sealed manner by the stopper 15.

As illustrated in FIG. 4, the stopper is removed to allow upside-down filling.

In a very simple embodiment, the stopper may be made of elastomer and be force fitted into the orifice in order to close the latter. The drawback is that the stopper must not be too long so as not to protrude too far into the chamber and risk tearing the tape when there is not very much mud left.

Preferably, the orifice 14 is extended, toward the outside of the chamber, by a peripheral rim 14*a* of given height Hc. This rim allows the engagement of a stopper which remains on the outside of the chamber.

Advantageously, the orifice 14 is circular and extended by a cylindrical rim 14*a*, allowing the use of a screw stopper.

Preferably, the screw stopper used is a stopper known as a "quarter turn" stopper.

Thus, the cylindrical rim 14*a* has two fins 14*b* arranged centrifugally and on diametrically opposite sides from one another.

In a complementary manner, the stopper has a rim of complementary shape, comprising two tabs arranged centripetally and on diametrically opposite sides from one another, the tabs being intended to be force-fitted between the fins and the lower wall when the stopper is closed and to pass between the fins when the stopper is pivoted through a quarter turn to open up the orifice.

As illustrated in FIG. 5, the lower wall 8 of the chamber is advantageously concave, as seen from the outside, with respect to a base plane P passing through the first 8*a* and the second 8*b* free end of the lower wall. Since these free ends 8*a* and 8*b* are segments of a straight line, the plane P is a single plane.

The lower wall 8 has a recess with a maximum height Hm, measured between the base plane P and a lowest point of the lower wall 8, greater than or equal to a height Ht of the orifice provided with the stopper. In other words, the height Ht represents the entire orifice (including the rim if appropriate) plus the stopper, in the application position, that is to say when the stopper is fastened on top of the orifice.

According to the invention, the orifice is arranged in the recess such that the stopper does not protrude beyond the base plane P.

In this way, when the stopper is fastened on the orifice, the stopper remains under the base plane or is flush with the base plane without protruding beyond it. By virtue of these characteristics of the recess in the lower wall 8, it is possible to rest the applicator stably on the free ends 8*a* and 8*b* even when the orifice is provided with the stopper according to the invention. This also makes it possible to avoid any scraping of the stopper against the plasterboard sheets during application of the tape.

FIGS. 5 to 7 illustrate the filling method according to the invention, allowed by the structure of the applicator and the arrangement of the orifice 14.

This filling is illustrated here with the supply hose 21 of a mud pump 20 (illustrated in FIG. 9).

In order to fill the applicator according to the invention for the first time, a free end B1 of the tape B is inserted beforehand into the chamber through the inlet slot 6 and the free end B1 of the tape B is withdrawn from the chamber through the outlet slot 9. The tape then extends freely through the chamber.

To carry out this operation, it is necessary to open the cover 11 in order to access the inside of the chamber.

According to one advantageous embodiment, the side wall 11 forming the removable side cover is mounted in a pivotable manner on the upper wall 16 via a hinge 11*a*, and comprises means 11*b* for reversibly fixing to the lower wall to allow leaktight reversible closure of the cover.

This allows easier access to the inside of the chamber and avoids mud getting into the hinge as a result of the user scraping their coating knife against the lower wall if they decide to fill the chamber in a traditional manner.

The applicator is then turned over to position it upside down such that the stopper is located in an upper position. It is then possible to open and insert into the orifice 14 a supply hose 21 of a pump 20 connected to a container 30 of mud 31.

The free end B1 of the tape B is kept out of the chamber and the pump is actuated in order that mud 31 enters the chamber in the direction of the arrow F1. In the chamber, the mud 31 pushed by the pump tends to drop to the bottom, that is to say toward the upper wall 16. On its way, as illustrated in FIG. 6, the mud 31 encounters the tape and pushes it back in the direction of the arrows F2 toward the upper wall 16, the rear wall 7 and the frontal wall 10 until the chamber has been filled (FIG. 7).

Since the roll of tape is free to turn, the tape extends automatically through the chamber without the user having to position it.

Moreover, unexpectedly, this upside-down applicator position and this manner of filling avoids any occurrence of twisting of the tape, which is pressed perfectly against the walls of the chamber.

Once the latter has been filled, the supply hose 21 of the pump is removed from the orifice 14 and the stopper is closed in order to obtain a full applicator of jointing tape that is ready to use.

This manner of filling is particularly advantageous during the tape application operation, when it is necessary to refill the chamber with mud, when the chamber is almost empty but has already been used.

In this case, the tape already extends freely through the chamber, a free end of the tape emerging from the chamber through the outlet slot.

The applicator is then turned over to position it upside down, and the stopper 15 of the orifice 14 borne by the lower wall 8 of the chamber 4 is opened.

A supply hose 21 of a pump connected to a container of mud is then inserted into the orifice 14, and then the free end B1 of the tape is kept out of the chamber and the pump is actuated so that mud enters the chamber.

In an embodiment that is not illustrated, the second free end 8*b* of the lower wall or the application head or the frontal wall comprises a means for temporarily holding the tape, to prevent the tape from retracting during filling. For example, means for adjusting the height of the tape can be used to temporarily immobilize the tape.

As described above, the mud enters the chamber perpendicularly to the tape and pushes it back by gravity toward the upper wall, the rear wall and the frontal wall until the chamber has been filled.

The supply hose 21 of the pump is then removed from the orifice 14 and the stopper 15 is closed in order to obtain a full applicator of jointing tape that is again ready to use.

Advantageously, a flexible connecting line 15*a* is fixed between the stopper 15 and the lower wall 8 of the chamber 4, preventing the stopper from being lost.

In this way, it is not necessary to open the cover and manually replace the tape in a chamber covered in mud. The refilling operation is therefore very clean and quick. It is possible to use a pump, a syringe or a funnel to introduce the mud manually.

In order to allow upside-down filling, the applicator according to the invention advantageously comprises two fixing hooks 17 that are intended, while the chamber is being filled with mud, to allow the applicator to be fixed against the edge of a bucket of mud (see FIG. 9), such that the stopper and the lower wall of the chamber are directed upward.

Preferably, the hooks 17 are borne by at least one of the side walls 11 or 12, or by an additional plate fixed to one or the other of the side walls 11 or 12.

In FIG. 8, the applicator 1 comprises such an additional plate 40 fixed to the wall 12, this plate 40 bearing the payout device 2 for paying out the tape from a roll.

The additional plate makes it possible to provide an applicator for right-handed people or left-handed people, depending on the side wall 11 or 12 to which it is fixed. By fixing it to the wall 11, the location of the payout device 2 is simply reversed, and an applicator for left-handed people is obtained, as explained below.

According to the invention, the hooks 17 comprise a fixing leg 17*a* for fixing to the side wall of the chamber (or to the additional plate 40).

The fixing leg 17*a* is extended angularly by a bearing leg 17*b* for bearing against a bucket edge 32 (see FIG. 9) while the chamber is being filled with mud.

According to the invention, the bearing leg 17*b* is extended angularly by an immobilizing leg 17*c* intended to immobilize the applicator against the wall of the bucket while the chamber is being filled with mud, and to prevent the applicator from tipping while it is being filled and once it has been filled.

The fixing leg 17*a* of each hook 17 advantageously has a groove 17*d* for a carry strap S of the applicator to pass through, this strap being intended to receive the user's hand in a position such that the user's fingers are in contact with the lower wall 8 during application of the tape.

In this way, when the hooks are fixed to an additional plate 40, which is itself fixed to one or the other of the side walls 11-12, it is possible to reverse the position of the additional plate and fix it to the other side wall. This reverses the fixing of the payout device 2 and of the hooks 17 such that the user can use their other hand to employ the applicator according to the invention.

The invention claimed is:

1. An applicator (1) of jointing tape for joining two sheets of plasterboard, the applicator comprising a payout device (2) for paying out a jointing tape (B) from a roll (3) and a mud chamber (4) through which the tape is paid out in use, the chamber having, with reference to the use position, a tape inlet slot (6) formed between a free end (7*a*) of a rear wall (7) of the chamber and a first free end (8*a*) of a lower wall (8) of the chamber, and a tape outlet slot (9) formed between a free end (10*a*) of a frontal wall (10) of the chamber and a second free end (8*b*) of the lower wall (8) of the chamber, the chamber also comprising an upper wall (16) and two side walls (11-12), one (11) of which constitutes a removable side cover for accessing the inside of the chamber, wherein the lower wall (8) comprises an orifice (14) provided with a removable stopper (15) for accessing the interior of the chamber, the orifice being directed toward the upper wall of the chamber, wherein at least one (12) of the side walls (11-12) has two fixing hooks (17) that are intended, while the chamber is being filled with mud, to allow the applicator to be fixed against an edge (32) of a bucket (30) of mud (31), such that the stopper and the lower wall of the chamber are directed upward.

2. The applicator (1) as claimed in claim 1, wherein the lower wall (8) of the chamber is concave, as seen from the outside, with respect to a base plane (P) passing through the first (8*a*) and the second (8*b*) free end of the lower wall, and has a recess with a maximum height (Hm) greater than or equal to a height (Ht) of the orifice (14) provided with the stopper (15), the orifice being arranged in the recess such that the stopper does not protrude beyond the base plane.

3. The applicator (1) as claimed in claim 1, wherein the hooks (17) comprise a fixing leg (17*a*) for fixing to the side wall of the chamber, the fixing leg being extended angularly by a bearing leg (17*b*) for bearing against the bucket edge while the chamber is being filled with mud, the bearing leg being extended angularly by an immobilizing leg (17*c*) intended to immobilize the applicator against a wall of the bucket while the chamber is being filled with mud.

4. The applicator (1) as claimed in claim 3, wherein the fixing leg (17*a*) of each hook has a groove (17*d*) for a carry strap (S) of the applicator to pass through.

5. The applicator (1) as claimed in claim 1, wherein the side wall forming the removable side cover is mounted in a pivotable manner on the upper wall, and comprises means (11*b*) for reversibly fixing to the lower wall to allow leaktight reversible closure of the cover.

6. The applicator (1) as claimed in claim 1, wherein the orifice is extended by a peripheral rim (14*a*) of given height.

7. The applicator (1) as claimed in claim 6, wherein the orifice is circular and extended by a cylindrical rim.

8. The applicator (1) as claimed in claim 7, wherein the cylindrical rim (14*a*) has two fins (14*b*) arranged centrifugally and on diametrically opposite sides from one another, the stopper having a rim of complementary shape, comprising two tabs arranged centripetally and on diametrically opposite sides from one another, the tabs being intended to be force-fitted between the fins and the lower wall when the stopper is closed and to pass between the fins when the stopper is pivoted through a quarter turn to open up the orifice.

9. The applicator (1) as claimed in claim 1, wherein a flexible connecting line (15*a*) is fixed between the stopper and the lower wall of the chamber.

10. A method for filling an empty applicator of jointing tape using a mud pump, comprising:

a) providing an applicator of jointing tape according to claim 1, and a bucket (30) of mud (31);

b) inserting a free end of the tape into the chamber through the inlet slot and withdrawing the free end of the tape from the chamber through the outlet slot, the tape extending freely through the chamber;

c) fixing the applicator against an edge (32) of the bucket (30) of mud (31) with the two fixing hooks (17), such that the stopper and the lower wall of the chamber are directed upward, and opening the stopper of the orifice borne by the lower wall of the chamber;

d) inserting a supply hose of a pump connected to the bucket of mud into said orifice;

e) keeping the free end of the tape out of the chamber and actuating the pump in order that mud enters the chamber, pushing the tape back toward the upper wall, the rear wall and the frontal wall until the chamber has been filled; and f) removing the supply hose of the pump from the orifice and closing the stopper in order to obtain a full applicator of jointing tape that is ready to use.

11. A method for adding mud to an applicator of jointing tape using a mud pump, comprising:

a) providing a bucket (30) of mud (31) and an applicator of jointing tape as claimed in claim 1, wherein the tape already extends freely through the chamber, a free end of the tape emerging from the chamber through the outlet slot, b) fixing the applicator against an edge (32) of the bucket (30) of mud (31) with the two fixing hooks (17), such that the stopper and the lower wall of the chamber are directed upward, and opening the stopper of the orifice borne by the lower wall of the chamber;

c) inserting a supply hose of a pump connected to the bucket of mud into said orifice;

d) keeping the free end of the tape out of the chamber and actuating the pump in order that mud enters the chamber, pushing the tape back toward the upper wall, the rear wall and the frontal wall until the chamber has been filled; and e) removing the supply hose of the pump from the orifice and closing the stopper in order to obtain a full applicator of jointing tape that is ready to use.

* * * * *